United States Patent [19]

Pitkjaan et al.

[11] 4,316,240

[45] Feb. 16, 1982

[54] INNER LAMP MOUNT ASSEMBLY FOR VEHICULAR HEADLAMP AND SIMILAR LIGHTING APPARATUS

[75] Inventors: Elam Pitkjaan, Cedar Grove; James F. Endler, East Hanover, both of N.J.

[73] Assignee: Westinghouse Electric Corp., Pittsburgh, Pa.

[21] Appl. No.: 146,996

[22] Filed: May 6, 1980

Related U.S. Application Data

[62] Division of Ser. No. 881,473, Feb. 27, 1978, Pat. No. 4,241,391.

[51] Int. Cl.[3] ..... F21V 29/00

[52] U.S. Cl. ..... 362/267; 362/61; 313/113

[58] Field of Search ..... 362/267, 61; 313/113

[56] References Cited

U.S. PATENT DOCUMENTS 3,917,939 11/1975 Schmidt ..... 362/267

4,241,391 12/1980 Pitkjaan ..... 362/267

*Primary Examiner*—Stephen J. Lechert, Jr.

*Attorney, Agent, or Firm*—D. S. Buleza

[57] ABSTRACT

The efficacy, life and beam intensity of a sealed-beam headlamp are enhanced by employing a compact baseless halogen-cycle incandescent lamp as the inner light source and mounting it in optically coupled relationship with the reflector component of the sealed-beam housing by a holder assembly that is rugged, light in weight, and inexpensive from both a material and manufacturing standpoint. The holder assembly comprises one or several sheet-metal components that are locked in embracing interfitting relationship with the press seal of the lamp envelope by welding the components to one or more of the lamp lead-in conductors and to the rigid main conductors carried by the reflector component. The halogen-cycle lamp and its rigid lead-in conductors thus constitute integral structural parts of the finished mount that mechanically retain the various components in their assembled relationship. The sheet-metal components and ends of the main conductors are so shaped that they provide stop means for positioning the halogen lamp and its filament in precise focussed relationship with the reflector surface of the sealed-beam housing.

6 Claims, 13 Drawing Figures

INNER LAMP MOUNT ASSEMBLY FOR VEHICULAR HEADLAMP AND SIMILAR LIGHTING APPARATUS

CROSS-REFERENCE TO RELATED APPLICATIONS

This is a division of application Ser. No. 881,473, filed Feb. 27, 1978, now U.S. Pat. No. 4,241,291.

BACKGROUND OF THE INVENTION

1. Field of the Invention

This invention relates to electric lamps and has particular reference to an improved sealed-beam lamp unit of the type used on motor vehicles for illuminating the roadway.

2. Description of the Prior Art

High intensity sealed-beam lamp units that employ a halogen-cycle type incandescent lamp as the light source are well known in the art. Such a lamp unit is disclosed in U.S. Pat. No. 3,553,519 and utilizes a ceramic support member that is slip-fitted into channels formed on the sealed end of the halogen lamp and is also coupled to a light shield. However, the halogen lamp is held in place by welding its lead wires to the stiff conductive leads that are attached to the reflector portion of the outer casing or housing. Various types of assemblies for holding a halogen-cycle type incandescent lamp in proper position with the reflector of a sealed-beam lamp unit using sheet-metal members that are slipped over the press seal of the halogen lamp or embedded therein are also known in the art. Such mount assemblies and techniques are disclosed in U.S. Pat. Nos. 3,848,120 issued to Wolfe et al., 3,909,607 issued to Vause et al. and 3,904,909 issued to Vause.

The use of sheet-metal holders or caps that are interlocked with the seal portion of a halogen-cycle lamp and are fastened to a support plate or a support wire to hold the lamp in the desired position within a sealed-beam unit are shown in U.S. Pat. Nos. 3,963,916 and 3,904,904. In other types of sealed-beam headlamps illustrated in U.S. Pat. Nos. 3,917,939 and 3,997,808, a halogen lamp is disposed in the desired position relative to the reflector component by cementing a sheet-metal or a ceramic holder to the press seal of the halogen lamp and then soldering or welding the lamp lead wires to the conductor portions of the lamp casing or housing.

SUMMARY OF THE INVENTION

While the prior art sealed-beam lamp units which employ a halogen-cycle type incandescent lamp as the light source were satisfactory from a functional standpoint, they require complicated mount structures that are expensive and difficult to assemble on a mass-production basis. The lamp-holding arrangements also entail the use of an excessive number of specially formed parts and, in some instances, require that metal supporting members be embedded in the press seal of the halogen lamp envelope. This not only further complicated lamp manufacture but created the potential problem of introducing strains in the hermetic seal which could eventually cause it to crack and leak. Moreover, in some of the prior art designs the halogen lamp is held in suspended position within the sealed-beam housing by a single support member or by welded support means which does not provide any protection against a mechanical or electrical failure of the mount assembly should the support member or its weld juncture break, particularly under the severe vibration and rough surface conditions to which the sealed-beam lamp unit is subjected when in use on a motor vehicle.

All of the foregoing manufacturing and quality problems and cost disadvantages are avoided in accordance with the present invention by providing a sealed-beam lighting unit with a compact baseless incandescent lamp, such as a halogen-cycle lamp, which is held in predetermined relationship with the reflector component by a mount assembly that uses a minimum number of parts that can readily be formed from sheet metal. The metal parts are so shaped and fastened to the rigid lead-in wires of the incandescent lamp and the main conductors of the reflector component that the lamp itself and its lead wires are used as structural parts of the mount assembly and the lamp is positively seated in prefocussed relationship with the reflector by the holder means. This is accomplished by employing a pair of sheet-metal clips as the lamp-holding means, slipping them onto the side edges of the press seal, and then locking them in such position by welding selected parts of the metal clips to the lamp lead-in conductors and the main conductors that are carried by the sealed-beam housing.

Each of the metal clips include a laterally-protruding tabular segments which is fastened to the respective lead-in wires of the lamp and also serves as stop means which enagages the end of the lamp seal and thus insures that the incandescent lamp is properly positioned relative to the reflector surface of the sealed-beam housing. The metal clips are preferably mechanically interfitted with the ends of the main conductors and subsequently welded to these members, as well as to the lamp lead-in conductors, to provide a mount structure that is rugged, very reliable from both a mechanical and electrical standpoint, and is inexpensive.

Various alternative mount embodiments for single-filament and dual-filament type compact incandescent lamps are also disclosed which utilize modified forms of sheet-metal holders that include additional features of the present invention.

BRIEF DESCRIPTION OF THE DRAWING

A better understanding of the invention will be obtained from the exemplary embodiments shown in the accompanying drawing, wherein.

DESCRIPTION OF THE PREFERRED EMBODIMENTS

While the present invention can be advantageously employed in various kinds of electric lamp units which contain a compact or miniature lamp that is mounted within a protective housing or casing, it is especially adapted for use in conjunction with sealed-beam lamp units of the type used as motor vehicle headlamps and it has accordingly been so illustrated and will be se described.

Figure 1:
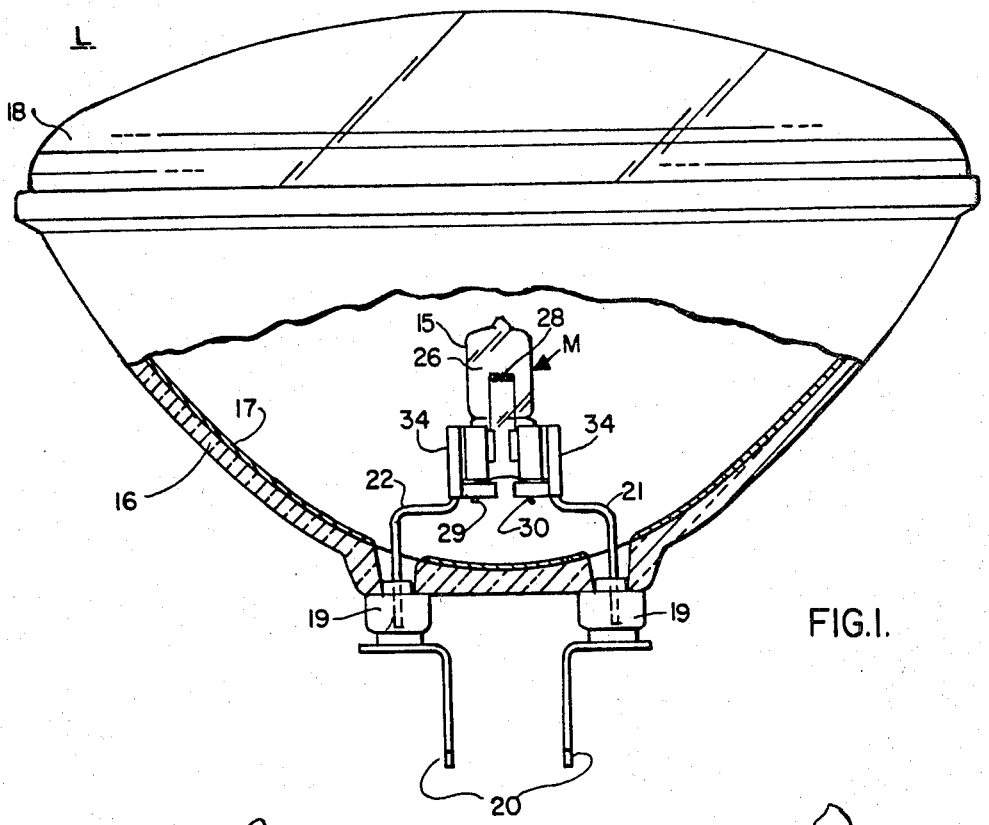
FIG. 1 is an elevational view of a sealed-beam lamp unit embodying the invention, a portion of the reflector component being removed to better illustrate the inner lamp component and the mount assembly.

A sealed-beam lamp unit L that embodies the invention and contains a mount assembly M which includes a compact single-filament incandescent lamp 15 is shown in FIG. 1. The lamp unit consists of the usual concave reflector component 16 that is molded from glass or other suitable vitreous material and is provided with an inner coating 17 of aluminum or the like which defines a reflector surface of parabolic or other suitable configuration. The reflector component 16 is peripherally sealed to a vitreous cover component 18 that is light transmitting and may be provided with integral flutes, prisms, and the like to serve as a lens which directs the transmitted light rays into a desired beam pattern in accordance with standard practice in the art. A pair of metal ferrules 19 are sealed into openings in the back of the reflector component 16 and have their outer ends brazed or otherwise fastened to a pair of blade-like connectors 20 which permit the lamp unit L to be inserted into the socket fixture of the motor vehicle. A pair of rigid main conductors such as lead-support wires 21, 22 or iron, nickel or nickel-plated iron are brazed to the ferrules 19 and extend inwardly into the concave reflector component 16 in the usual fashion. The housing or casing formed by the reflector 16 and a lens-cover 18 is evacuated and filled with a non-oxidizing inert gas, such as argon or nitrogen at a suitable pressure, in accordance with the usual practice.

The incandescent lamp 15 is preferably of the halogen-cycle type and comprises an integral structural part of a mount assembly M which retains it in the proper optical relationship with the focal point of the reflector defined by the specular metal coating 17. The compact lamp 15 thus includes a vitreous envelope 26 of suitable high-temperature material (such as quartz, Vycor or hard glass) and contains a tungsten filament 28, an inert fill gas such as nitrogen at a suitable fill pressure, and a measured amount of a halogen such as iodine or bromine that is introduced into the envelope during lamp manufacture either in elemental form or in the form of a suitable halogen-containing compound. The lamp 15 is anchored to the inner end portions of the lead-support wires 21, 22 by a holder assembly that is fabricated from sheet metal and, in this particular embodiment, comprises a pair of clip-like members 34 that nestingly embrace a selected part of the lamp envelope and are fastened to the lead-support wires 21 and 22 and to a pair of rigid lead-in conductors such as molybdenum wires 29 and 30 that extend from the lamp 15.

Figure 2:
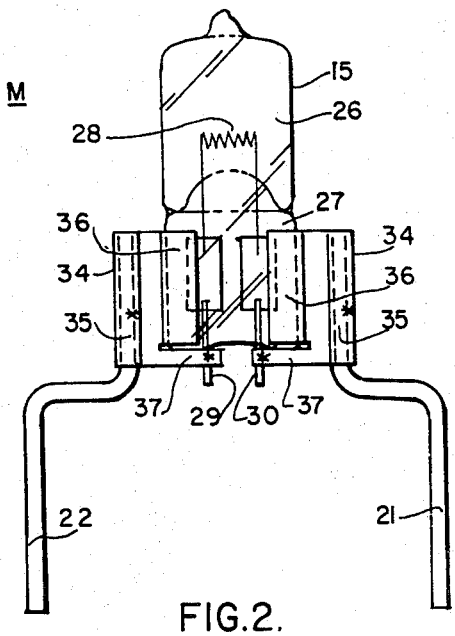
FIGS. 2 and 3 are enlarged front and side views, respectively, of the inner lamp component and mount assembly shown in FIG. 1.
Figure 3:
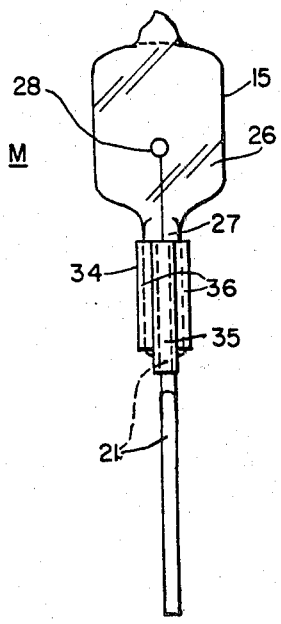

As shown more clearly in FIGS. 2 and 3, the incandescent halogen-cycle lamp 15 is of the baseless type and terminated at one end by a pinch or press seal 27 of fused vitreous material that is generally rectangular in shape and thus has two side edges and an end face from which the rigid lead-in wires 29 and 30 extend. The tungsten filament 28 is suspended within the envelope 26 in the usual manner by attaching it to a pair of inner lead-in conductors that are fastened to a pair of metal foils or ribbons that are hermetically embedded in the press seal and connected to the rigid outer lead-in wires 29 and 30. Lead-in wires 29, 30 may be made of molybdenum and each may comprise a one-piece lead, if desired, thus eliminating the need for ribbons and conjoined inner heads.

Figure 4:
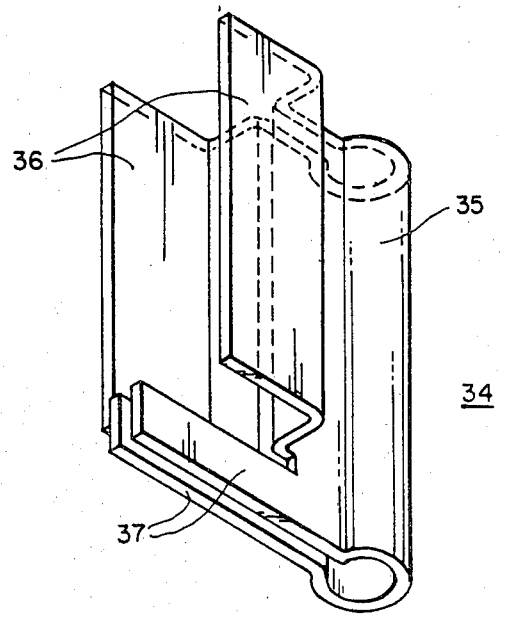
FIG. 4 is an enlarged pictorial view of one of the sheet-metal lamp-holding members.

As will be noted in FIG. 4, each of the clip-like members 34 are fabricated from a single piece of suitable sheet metal (such as stainless steel or cold rolled steel) that is bent to provide a hollow tubular segment 35 that merges with a pair of laterally extending panels 36 that define a pocket of generally U-shaped cross-section which is located above a pair of laterally extending tabular segments 37. The tabular segments extend from the terminus of tubular segment 35 and are disposed closer to one another than the panels 36 and thus partially close and obstruct the entrance to the pocket. The spacing of the panels 36 is such that they snugly embrace and nestingly accommodate the side edges of the press seal 27 when the lamp 15 is inserted into the clip-like members 34. The spacing between the tabular segments 37 is just slightly larger than the cross-sectional dimension of the lead-in wires 29, 30 and the inner dimension of the tubular segments 35 are such that they snugly receive the inserted end portions of the large-diameter lead-support wires 21, 22.

Figure 5:
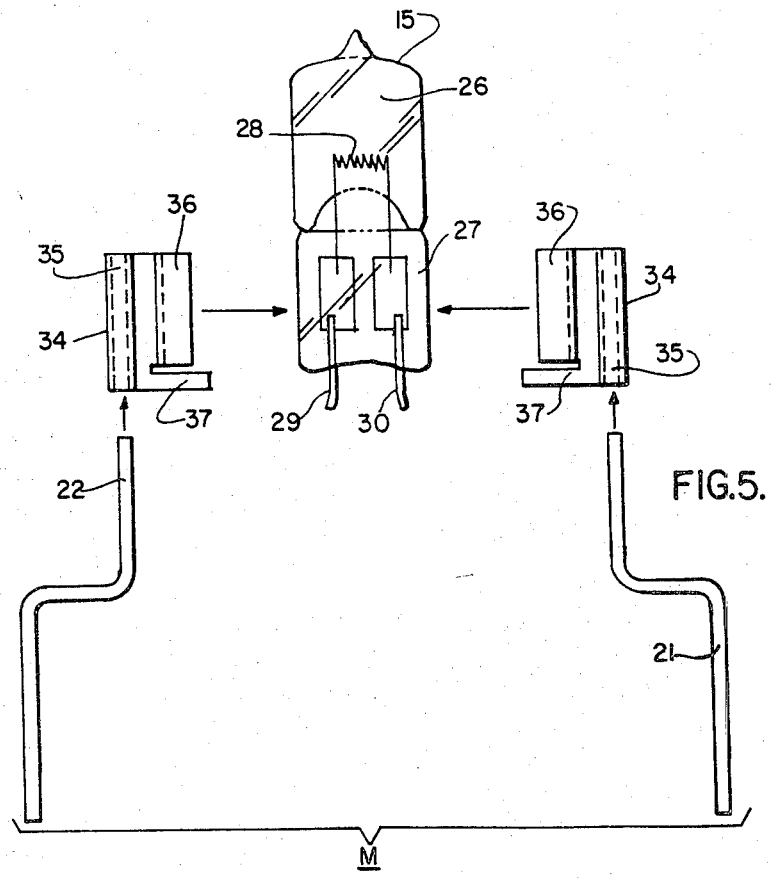
FIG. 5 is an exploded view of the mount components showing the manner in which they are assembled with the halogen lamp to form the mount.

The manner in which the halogen-cycle lamp 15 is interfitted with the clip-like members 34 and lead-support wires 21, 22 to form the mount assembly M is shown in FIG. 5. As indicated, the inner end portions of the wires 21 and 22 are inserted into the tubular segments 35 of the respective clip-like members 34 and the latter are then slip-fitted onto the side edges of the press seal 27 of the lamp envelope 26 with the respective lead-in wires 29 and 30 of the lamp 15 disposed between the associated tabular segments 37 and with the latter seated against the curved end face of the press seal, thus producing the mount M shown in FIGS. 1–3. The tabular segments 37 accordingly serve as stop means for the press seal 27 and insure that the lamp 15 is oriented in the proper relationship with the main conductors 21 and 22. This is important since the lamp filament 28 must be located in predetermined optical relationship with the focal point of the paraboloidal reflector component 16 in order to control the beam pattern and beam intensity.

Proper positioning of the lamp 15 relative to the lead-support wires 21, 22 is also insured by the fact that the inner end portions of the wires are bent toward one another (as shown in FIGS. 1, 2 and 5) and the clip-like members 34 are pressed down onto the ends of the wires until the members engage the right-angle bends of the respective wires and the parts are in force-fitted telescoped relation.

The mount components are mechanically locked in their assembled relationship by welding the tubular segments 35 of the clip-like members 34 to the enclosed ends of the lead-support wires 21 and 22 and also welding the tabular segments 37 to the respective lamp lead-in wires 29 and 30, the welds being indicated by the "asterisk" indicia shown in FIG. 2. Since the metal clip-like members 34 embrace and extend over only the side edge portions of the press seal 27, they are physically and electrically isolated from one another and serve as mechanical and electrical coupling members for the halogen-cycle lamp 15, with the various components of the mount assembly M being held together by the lamp 15 itself and its rigid lead-in wires 29 and 30.

The positioning of the finished mount M relative to the reflector component 16 is achieved by inserting the free ends of the lead-support wires 21, 22 into the ferrules 19, adjusting the location of the mount M until the desired orientation with the reflector surface 17 is obtained, and then brazing the wires to the ferrules. The lens-cover 18 is then joined to the reflector component 16, the resulting airtight casing is evacuated, charged with fill gas and finally hermetically sealed in the usual manner.

ALTERNATE MOUNT EMBODIMENT (FIGS. 6–7)

Figure 6:
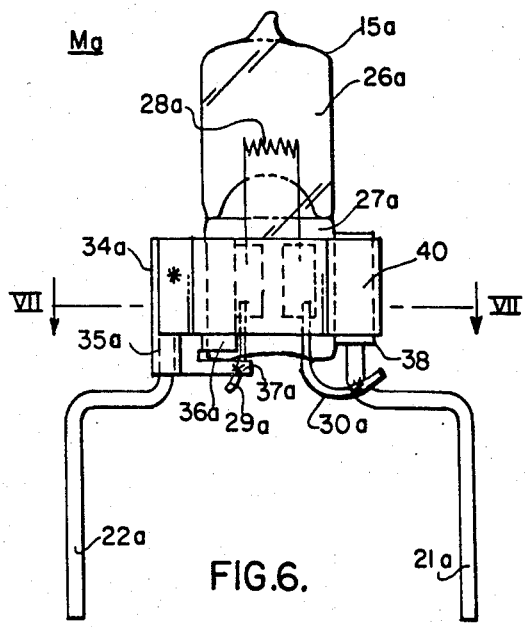
FIGS. 6 and 7 are front elevational and sectional views, respectively, of another mount assembly which employs a modified sheet-metal holder.
Figure 7:
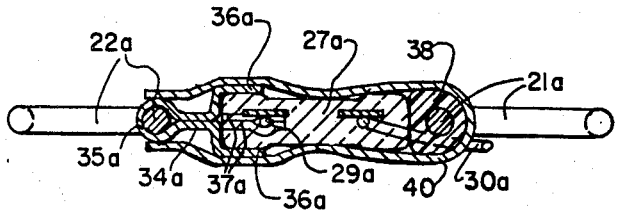

A modified sealed-beam lamp mount assembly $M_a$ that includes a single-filament type halogen lamp 15*a* is shown in FIGS. 6 and 7.

As will be noted, it employs only one clip-like member 34*a* of sheet metal that is slip-fitted over a side edge of the press seal 27*a* of the lamp envelope 26*a* and has its tabular segments 37*a* welded to one of the lamp lead-in wires 29*a* and its hollow tubular segment 35*a* disposed in telescoped and welded relationship with the end portion of the associated lead-support wire 22*a*. According to this embodiment, however, the other rigid lead-in wire 30*a* is connected directly to the end portion of the other lead-support wire 21*a* by a weld to complete the electrical circuit with the lamp filament 28*a*. Lead-support wire 21*a* is mechanically coupled to the lamp 15*a* by slipping a suitable sleeve-like insulator 38 of suitable ceramic over the end portion of the wire 21*a* and clamping it and the wire 21*a* in compressed abutting relationship with the side edge of the press seal 27*a* by a U-shaped band 40 of sheet metal.

As shown most clearly in FIG. 7, the metal band 40 laterally extends around the press seal 27*a* and overlies the clip-like member 34*a* and has its free ends welded to the tubular segment 35*a* of the clip-like member. The closed or "loop" end of the metal band 40 overlies and tightly grips the insulator 38 so that all of the mount components are securely locked together and the welds joining the lead-in wires 29*a* and 30*a* to the clip-like member 34*a* and lead-support wire 21*a*, respectively, are reinforced and thus protected from mechanical shocks and stresses which might cause the welds to fracture and render the sealed-beam lamp unit inoperable.

ALTERNATE MOUNT EMBODIMENT (FIGS. 8–9)

Figure 8:
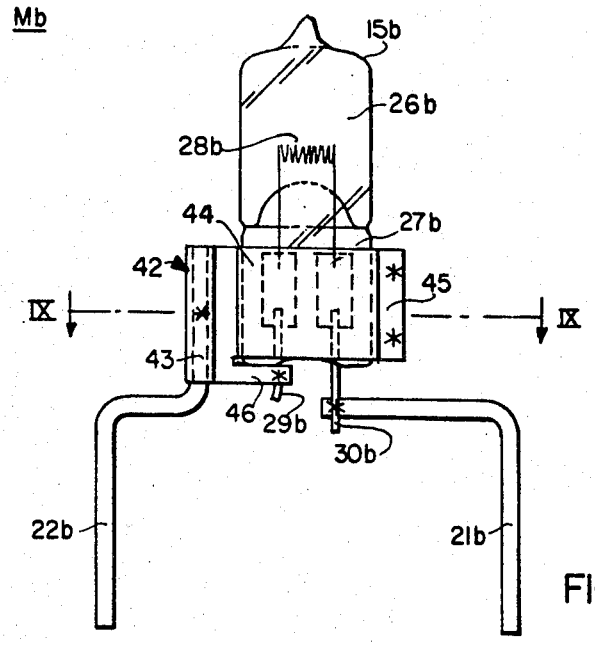
FIGS. 8 and 9 are front elevational and sectional views, respectively, of still another mount embodiment utilizing a single-filament incandescent lamp and a one-piece metal holder.
Figure 9:
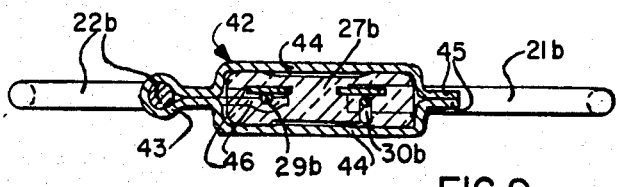

An alternate sealed-beam mount embodiment $M_b$ which requires only one sheet-metal component is shown in FIGS. 8–9. As illustrated, according to this embodiment the rigid lead-in wire 30*b* of the halogen incandescent lamp 15*b* is welded directly to the end portion of one of the stiff lead-support wires 21*b* which is bent so that its end portion extends laterally and terminates adjacent the end of the press seal 27*b*. The other main conductor 22*b* is mechanically and electrically coupled to the lamp 15*b* by a sleeve-holder 42 of sheet metal that laterally extends around the press seal 27*b* and is electrically isolated from the lead-in wire 30*b* and conjoined main conductor 21*b*.

As will be noted in FIG. 9, the sleeve-holder 42 is fabricated from a single piece of sheet metal and has its free ends disposed in overlapped welded relationship with one another and bent around one side edge of the press seal 27*b*. The opposite or closed end of the metal sleeve holder is formed into a hollow tubular segment 43 that is slipped over and welded to the end portion of the other main conductor 22*b*.

As in the pevious embodiments, the sheet-metal holder 42 has paired laterally-extending tabular segments 46 (FIG. 8) that are spot welded in overlapped relationship with the other lamp lead-in wire 29*b* and also serve as a seat and stop means for the end of the press seal 27*b* to insure proper positioning of the lamp 15*b* relative to the main conductors 21*b*, 22*b* and the reflector component of the sealed-beam lighting unit.

DUAL-FILAMENT EMBODIMENT (FIGS. 10–13)

The invention is not limited to sealed-beam lighting units that contain single-filament incandescent lamps as inner light sources but can also be employed with headlamps and lighting units that contain dual-filament lamps of compact size.

Figure 10:
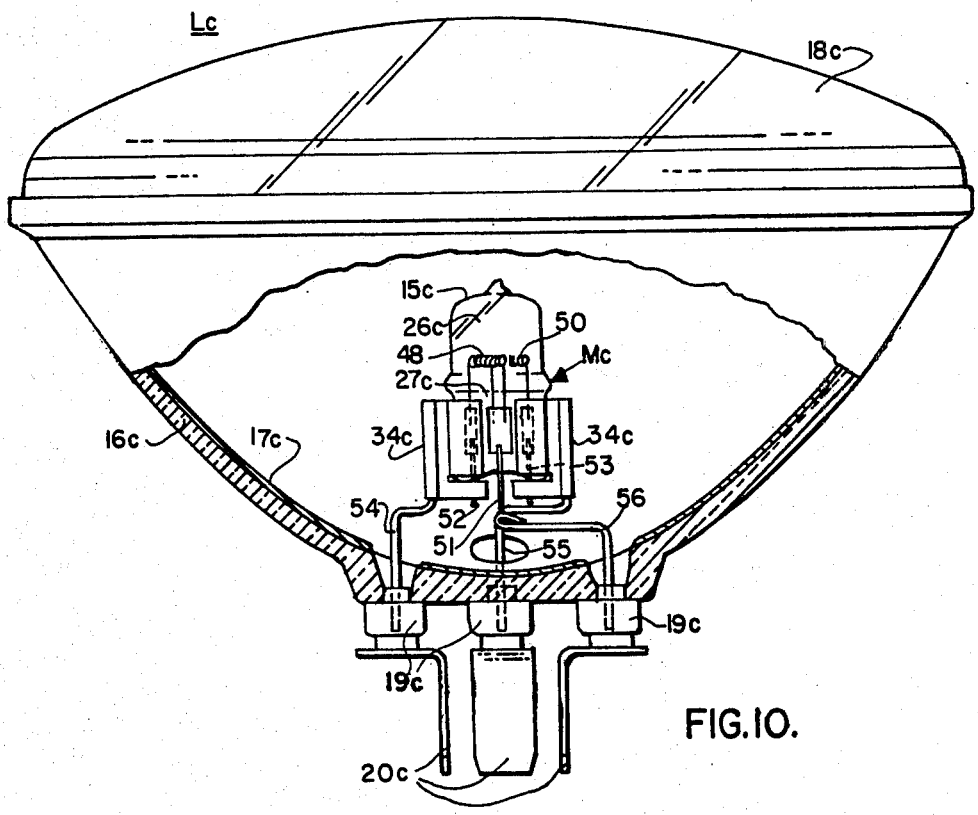
FIG. 10 is an elevational view, partly in section, of another sealed-beam lamp unit which is provided with a dual-filament incandescent lamp and accommodating mount assembly pursuant to the invention.

A sealed-beam unit $L_c$ of such construction is shown in FIG. 10 and consists of the usual concave component 16*c* of glass or other suitable material that has a reflective inner surface 17*c* and is hermetically joined along its periphery to a light-transmitting cover or lens 18*c*. The resulting airtight housing encloses a mount assembly $M_c$ that includes a compact incandescent lamp 15*c* which contains a pair of tungsten 48 and 50. The inner lamp component 15*c* is preferably of the halogen-cycle type and, in accordance with the usual practice in the art, one end of each of the filaments 48, 50 is connected to a single outer lead-in wire 51 through a common ribbon or foil conductor that is hermetically embedded in the press seal 27*c* which is formed on the end of the lamp envelope 26*c*. Lead-in wire 51 is thus electrically "common" to both filaments. The other ends of the filaments 48 and 50 are connected to separate lead-in wires 52 and 53, respectively, by separate foil conductors that are also embedded in the press seal. The outer lead-in wires 51, 52, 53 are composed of molybdenum, or other suitable rigid conductive material, since they are used to mechanically anchor the lamp 15*c* in place as previously described.

As in the previous embodiments, the compact incandescent lamp 15*c* is mechanically and electrically coupled to the main conductors of the concave reflector member 16*c* by a sheet-metal holder assembly that engages the press seal 27*c* and utilizes the lamp 15*c* itself and its outer leads as the components that lock the mount elements together in operative relation. Since the lamp 15*c* contains a pair of filaments, the reflector component 16*c* is provided with three sealed-in metal ferrules 19*c* and associated blade connectors 20*c*, and the ferrules are brazed to three rigid lead-support wires 54, 55 and 56 of iron, nickel or nickel-plated iron that extend inwardly into the reflector component.

Figure 11:
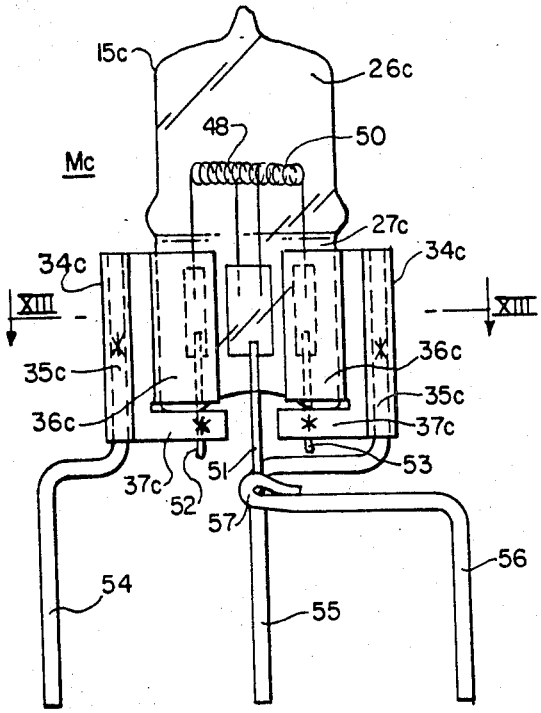
FIGS. 11 and 12 are front and side elevational views, respectively, of the mount assembly shown in FIG. 10; and, FIG. 13 is an enlarged cross-sectional view through the lamp mount, along line XIII—XIII of FIG. 11.

As shown more clearly in FIGS. 11–13, body portion of lead-support wire 56 is disposed in substantially the same plane as wire 54 but has its end portion bent laterally and skewed slightly so that it terminates below and adjacent the end of the press seal 27*c* in line with the protruding "common" lead-in wire 51. As will be noted, the tip of lead-in wire 51 is also bent to extend laterally and the tip of the lead-support wire 56 is formed into a clamp 57 that is crimped in positive electrical engagement around the tip of the common lead-in wire. The remaining lead-support wires 54 and 55 are mechanically and electrically coupled to the other lead-in wires 52 and 53 of the lamp 15*c* by a sheet-metal holder assembly which comprises a pair of clip-like members 34*c*, each of which are formed from a single piece of material and are constructed in the same fashion as described in the FIGS. 1–3 embodiment. The side edges of the press seal 27*c* are thus slip-fitted into snug nested relationship with the panel segments 36*c* of the clip-like members 34*c* and the end of the press seal 27*c* is seated against the paired tabular segments 37*c* that are spot welded to the respective lead-in wires 52 and 53. Hollow tubular segments 35*c* of the clip-like members are in telescoped relationship with and welded to the bent end portions of the lead-support wires 54 and 55 that are located adjacent to and extend along the side edges of the press seal 27*c*, the welds being indicated by asterisks as in the previous embodiments.

Figure 12:
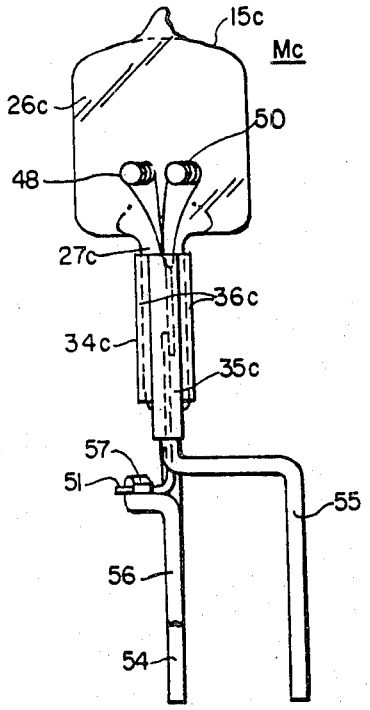
Figure 13:
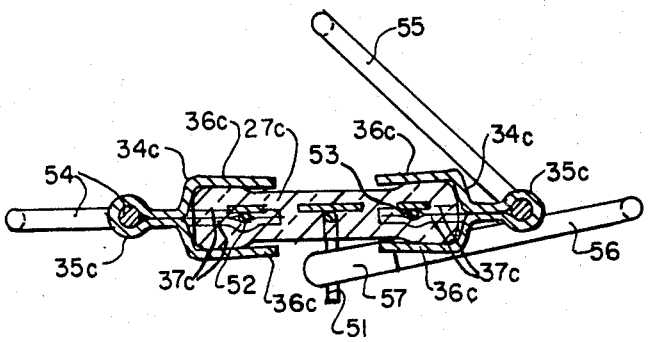

As will be noted in FIGS. 12 and 13, the laterally-extending medial portion of lead-support wire 55 is disposed at an angle relative to the plane containing the press seal 27*c* and tubular segments 35*c* of the clip-like members 34*c* so that the straight body portion of wire 55 is aligned with and extends into the associated ferrule 20*c*.

As will be appreciated to those skilled in the art, the sheet-metal components of the holder assembly employed in each of the embodiments are so shaped and designed that they can be readily fabricated and assembled with the incandescent lamp and stiff main conductors of the reflector component in a positive and efficient manner on a mass-production basis, using suitable jigs and welding apparatus, to provide a mount structure that is light in weight and inexpensive but rugged and able to withstand the high-temperature environment characteristic of halogen-cycle type lamps. While a vitreous reflector component of paraboloidal shape and circular periphery has been illustrated in each of the embodiments, the invention is not limited to sealed-beam headlamps utilizing such components but can also be used with equal advantage in headlamps of rectangular configuration and those which employ a sheet-metal reflector that is fitted with a glass lens member. The juncture of the metal parts of the mount with the lamp conductors can also be effected by brazing or soldering instead of welding, if desired.

We claim as our invention:

1. An integral lamp-mount assembly for use in a vehicular headlamp and similar lighting units that have a concave reflector component, said lamp-mount assembly comprising;

a pair of substantially rigid main conductors that (a) are adapted to be fastened to terminal means carried by the reflector component of the headlamp and (b) have end portions which are disposed in spaced side-by-side relationship, a baseless type incandescent lamp of compact size having an envelope that contains a filament and is terminated by a hermetic seal from which a pair of substantially rigid lead-in wires extend, said lead-in wires being anchored in the hermetic seal and connected to the filament and said hermetic seal having a pair of side edges, and means mechanically and electrically coupling the compact incandescent lamp to the end portions of the main conductors comprising a pair of spaced clip-like holders of sheet metal that are disposed in snug interfitted embracing relationship with the respective side edges of the hermetic seal, are fastened to the end portions of the respective main conductors, and have segments that extend laterally along the end face of the hermetic seal, the laterally-extending segments of each of said clip-like holders being seated against the end face of the hermetic seal and also being fastened to the respective lead-in wires of the compact lamp and thereby serving as positioning and electrical-connector means for the compact incandescent lamp.

2. The lamp-mount assembly of claim 1 wherein the lead-in wires extend outwardly from the end face of the hermetic seal and the segments of said clip-like sheet-metal holders which extend along said end face each comprise a tubular segment which is welded to the associated lamp lead-in wire.

3. The lamp-mount assembly of claim 1 wherein each of said clip-like sheet-metal holders also have a hollow tubular segment that is disposed in slip-fitted telescoped overlying relationship with the end portion of the associated main conductor and is fastened thereto by a weld.

4. An integral lamp-mount assembly adapted for use in a vehicular headlamp and similar lighting units that have a concave reflector component, said lamp-mount assembly comprising;

a pair of substantially rigid main conductors that (a) are adapted to be fastened to terminal means carried by the reflector component of the headlamp and (b) have end portions which are disposed in spaced side-by-side relationship, a baseless type incandescent lamp of compact size having an envelope that contains a filament and is terminated by a hermetic seal from which a pair of lead-in wires extend, said lead-in wires being anchored in the hermetic seal and connected to the filament, means mechanically coupling the compact incandescent lamp to the end portions of the main conductors comprising a pair of spaced clip-like holders of sheet metal that are disposed in interfitted embracing relationship with peripheral portions of the hermetic seal, each of said holders having a hollow tubular segment that is disposed in slip-fitted telescoped overlying relationship with the end portion of one of the main conductors and is secured thereto, and means electrically connecting the clip-like holders with the respective lead-in wires and, together with said telescoped tubular segments, maintaining said holders and main conductors in assembled relationship with the hermetic seal and the compact lamp.

5. The lamp-mount assembly of claim 4 wherein the lamp lead-in wires extend outwardly from the end of the hermetic seal and said clip-like holders of sheet metal are in interfitted embracing relationship with longitudinally-extending side edges of the hermetic seal.

6. The lamp-mount assembly of claim 4 wherein the hollow tubular segments of the clip-like holders comprise the longitudinal side segments of the respective holders and are welded to the end portions of the associated main conductors in telescoped overlying relationship therewith.

* * * * *